US007073574B2

(12) United States Patent
Smithey et al.

(10) Patent No.: US 7,073,574 B2
(45) Date of Patent: Jul. 11, 2006

(54) METHOD AND APPARATUS FOR FORMING FINS FOR A HEAT EXCHANGER

(75) Inventors: David W Smithey, Adrian, MI (US); Milan A Virsik, Adrian, MI (US)

(73) Assignee: Brazeway, Inc., Adrian, MI (US)

( * ) Notice: Subject to any disclaimer, the term of this patent is extended or adjusted under 35 U.S.C. 154(b) by 137 days.

(21) Appl. No.: 10/785,771

(22) Filed: Feb. 23, 2004

(65) Prior Publication Data

US 2005/0183852 A1 Aug. 25, 2005

(51) Int. Cl.
*F28D 1/04* (2006.01)

(52) U.S. Cl. ..... 165/151

(58) Field of Classification Search ..... 165/151, 165/152; 29/890.047
See application file for complete search history.

(56) References Cited

U.S. PATENT DOCUMENTS

| | | | | |
|---|---|---|---|---|
| 2,437,452 | A * | 3/1948 | Baird | 165/151 |
| 2,462,511 | A | 2/1949 | Kramer | |
| 2,672,324 | A | 3/1954 | Weiss | |
| 3,780,799 | A | 12/1973 | Pasternak | |
| 4,053,014 | A | 10/1977 | Neff et al. | |
| 4,434,843 | A | 3/1984 | Alford | |
| 4,492,851 | A * | 1/1985 | Carr | 165/181 |
| 4,580,623 | A | 4/1986 | Smitte et al. | |
| 4,778,004 | A | 10/1988 | Paulman et al. | |
| 5,183,105 | A | 2/1993 | Adams | |
| 5,535,820 | A | 7/1996 | Beagle et al. | |
| 5,540,276 | A | 7/1996 | Adams et al. | |
| 6,253,839 | B1 | 7/2001 | Reagen et al. | |
| 6,370,775 | B1 | 4/2002 | Reagen et al. | |
| 6,598,295 | B1 * | 7/2003 | Utter | 29/890.047 |

* cited by examiner

*Primary Examiner*—Teresa J. Walberg
(74) *Attorney, Agent, or Firm*—Harness, Dickey & Pierce, P.L.C.

(57) ABSTRACT

A fin for use on a heat exchanger and a method for making the same. The fin is made by stamping individual columns of openings in the fin such that adjacent columns are equally spaced apart. The outermost column of openings is spaced from a side edge of the fin a distance that is about one-half of the distance between adjacent columns of openings. The uniform spacing allows for the construction of a fin requiring any number of columns of openings to correspond to the tube portion that is used to form the heat exchanger. This spacing provides for an efficient and compact design of the tube portion and of the heat exchanger formed with the tube portion and the fins.

22 Claims, 10 Drawing Sheets

METHOD AND APPARATUS FOR FORMING FINS FOR A HEAT EXCHANGER

FIELD OF THE INVENTION

The present invention relates to heat exchangers, and more particularly to methods and apparatus for forming fins for use on a heat exchanger.

BACKGROUND OF THE INVENTION

Heat exchangers are used in a wide variety of applications and come in a wide variety of configurations to fit these various applications. A typical heat exchanger uses a fluid transporting unit or tube portion operable to transport a fluid therethrough, such as heat conducting tubing arranged in a sinuous configuration, and a plurality of heat conducting fins (fin bank) in heat conducting contact with the tube portion. One fluid flows through the tube portion and another fluid flows along the outer surface of the tube portion between the fins thereon to transfer heat between the two fluids. Typically the tube portion is arranged in a sinuous configuration with substantially straight segments being interconnected by connecting segments (typically semicircular segments) so that the fluid flowing within the tube portion passes through the fin bank a desired number of times. Due to the differing applications that the heat exchangers are used in, the heat exchangers will come in a variety of shapes that require fins having differing quantities of columns of openings that the straight segments pass through.

The fins are typically stamped from a sheet of heat conducting material with a die configured to produce a plurality of columns of openings in the sheet for each stamp of the die (i.e., 2, 3, 4, etc. columns per stamp). The number of rows of openings in each column is determined by the height of the sheet of heat conducting material from which the fins are stamped (i.e., the sheet can have a height that yields 2, 3, 4, etc. rows of openings per stamp of the die). To make the heat exchanger more compact, the dies are configured so that the openings in each column overlap the openings in an adjacent column formed in the same stamp of the die. With this configuration, however, a straight line cannot be drawn between adjacent columns formed from the same stamp of the die.

To accommodate tube portions requiring fins having more columns than the die can produce in a single stamp, the sheet is stamped multiple times to produce a desired number of columns of openings. Thus, a two column die can be used to make fins having two columns of openings or multiples thereof (i.e., 4, 6, 8, etc. columns). Likewise, a three column die can be used to make fins having three columns of openings or multiples thereof (i.e., 3, 6, 9, etc. columns). When making fins that require the die to stamp the sheet of heat conducting material multiple times to produce each fin, however, the spacing between the adjacent columns formed in different stamps of the die is larger than the spacing between the adjacent columns formed in the same stamp of the die due to the overlapping nature of the openings in adjacent columns formed in the same stamp of the die. For example, in a fin having six columns of openings formed from a die capable of producing two columns of openings per stamp, the spacing between columns two and three will be greater than the spacing between columns one and two and between columns three and four. Likewise, the spacing between columns four and five will be greater than the spacing between columns three and four and between columns five and six. This additional spacing is necessary to provide a straight line between tube columns three and four and between columns five and six to allow a cut to be made between the tube columns.

Due to this extra spacing between adjacent columns formed from different stamps of the die, the arrangement of the straight and interconnecting segments of the fluid transporting unit are spaced apart at different dimensions to accommodate the spacing of the columns of the fin. This extra spacing can increase the overall size of the heat exchanger thereby not making efficient use of the available space in which the heat exchanger is to be used. Additionally, this spacing increases the complexity of forming the tube portion due to the necessity of ensuring that the various segments align with the spacing of the columns in the fin which increases the cost of producing the heat exchanger. Thus, it would be advantageous to produce a fin that can be made with any desired number of columns while being compact to enable efficient use of the available space. It would also be advantageous to produce a fin having any desired number of columns of openings that can be used on a tube portion without requiring differing spacing of the segments of the tube portion to accommodate differing spacing between columns of openings in the fin.

SUMMARY OF THE INVENTION

The present invention provides a heat exchanger fin and method that enables the fin to be constructed for use with a tube portion requiring any number of columns of openings to fit on the tube portion. The columns are equally spaced apart which enables the tube portion to be configured with each of the tube passes being equally spaced apart. The equal spacing provides a compact and uniform design for a heat exchanger using such a fin and enables the production of fins having any desired number of columns of openings with the same die stamp. A heat exchanger utilizing such fins is also disclosed.

A heat exchanger fin according to the principles of the present invention includes a heat conducting sheet having a top edge, a bottom edge, and a pair of side edges that extend between the top and bottom edges. There are at least two columns of openings in the sheet. The columns extend substantially parallel to the side edges. Each of the openings in the columns are configured to allow at least a pair of substantially parallel portions of a tube portion to pass therethrough. The columns are equally spaced apart. A distance from an outermost portion of an opening in an outermost column to a nearest side edge is about one-half of a distance between closest portions of adjacent openings in adjacent columns.

A heat exchanger according to the principles of the present invention is also disclosed. The heat exchanger includes a tube portion which has a plurality of straight segments interconnected by a plurality of connecting segments. Each connecting segment interconnects two straight segments. The straight and connecting segments are arranged in a sinuous configuration. There is at least one heat conducting fin on the tube portion. The fin has a top edge, a bottom edge, and a pair of side edges that extend between the top and bottom edges. The fin has at least one column of openings. The column extends substantially perpendicular to the top edge with each of the openings in the column configured to allow at least a pair of parallel straight segments of the tube portion to pass therethrough. A distance from an outermost portion of an opening in an outermost column to a nearest side edge is about one-half of a distance between closest portions of parallel straight tube segments of the tube portion in a direction substantially parallel to the top edge.

A method of making a heat exchanger according to the principles of the present invention is also disclosed. The method includes (1) forming at least one heat conductive fin having a predetermined number of columns of openings extending therethrough with the columns extending substantially parallel to a side edge of the fin, each of the openings in the columns configured to allow at least a pair of substantially parallel portions of a tube portion to pass therethrough, the columns being equally spaced apart and a distance from an outermost portion of an opening in an outermost column to a nearest side edge of the fin is about one-half of a distance between closest portions of adjacent openings in adjacent columns; and (2) positioning the fin in heat conducting contact on a tube portion with a majority of the openings having at least a pair of substantially parallel portions of the tube portion passing therethrough.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The following description of the preferred embodiment is merely exemplary in nature and is in no way intended to limit the invention, its application, or uses.

Figure 1A:
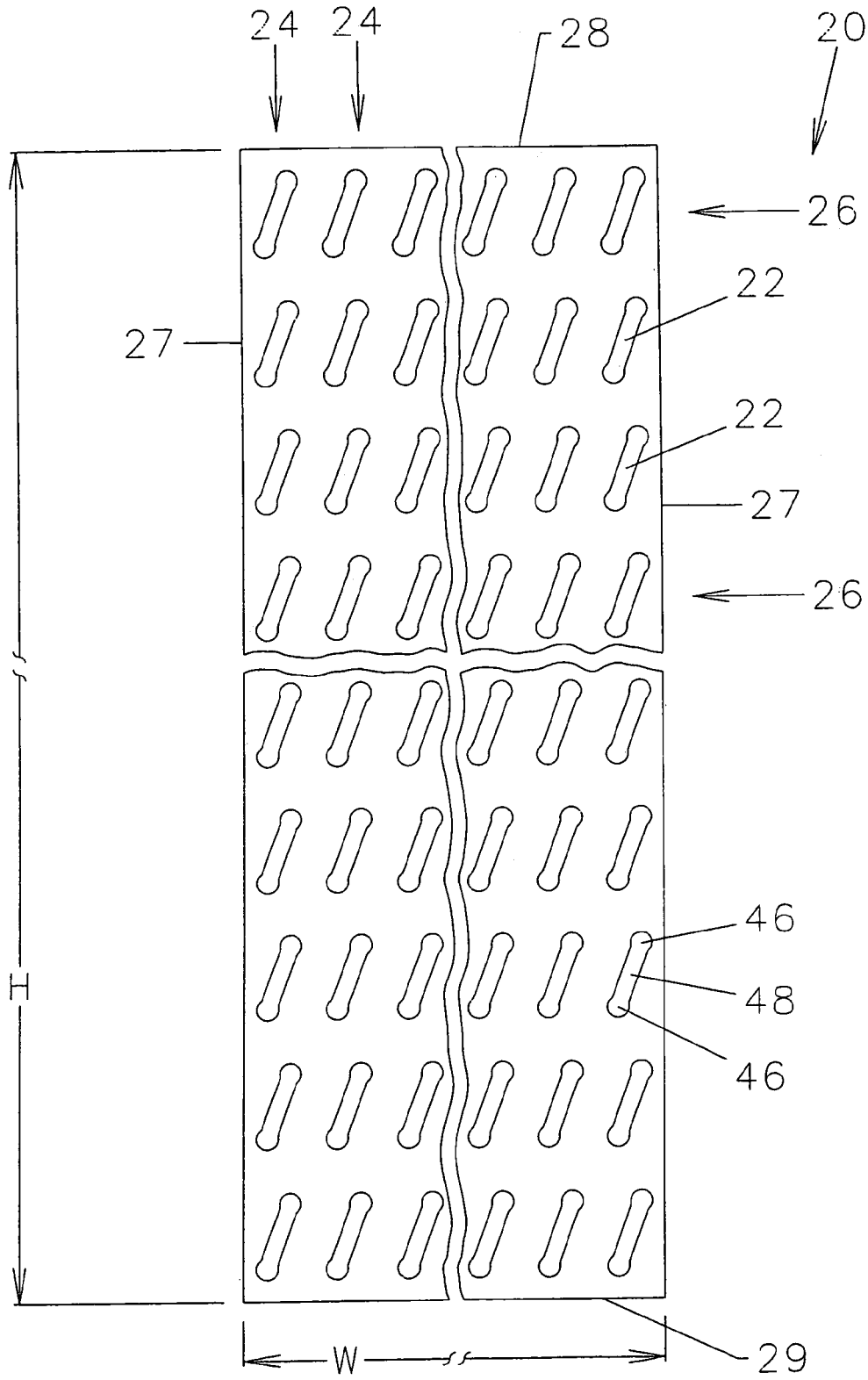
FIG. 1A is a front elevation view of a heat exchanger fin according to the principles of the present invention.

Referring now to FIG. 1A, there is shown a heat exchanger fin 20 in accordance with the principles of the present invention. The fin 20 has a plurality of openings 22 that are each configured and adapted to allow tube passes on a heat exchanger to pass therethrough when the fin 20 is used as a fin on a fin on tube heat exchanger, as will be explained in more detail below. The fin 20 has a height H and a width W. The openings 22 are arranged into a plurality of columns 24 and form a plurality of rows 26. The columns 24 are equally spaced apart. Similarly, the rows are also equally spaced apart. Preferably, the spacing between rows 26 is the same as the spacing between columns 24. The fin 20 can be produced with any number of columns 24 and rows 26 of openings 22, such as those shown in FIGS. 1B and C, for use on a tube portion such as that shown in FIG. 2, of a fin on tube heat exchanger 32, as will be discussed in more detail below. The columns 24 are substantially parallel to side edges 27 of fin 20 and extend from a top edge 28 to a bottom edge 29 of fin 20. The rows 26 are substantially parallel to top and bottom edges 28, 29 and extend between side edges 27.

Figure 2:
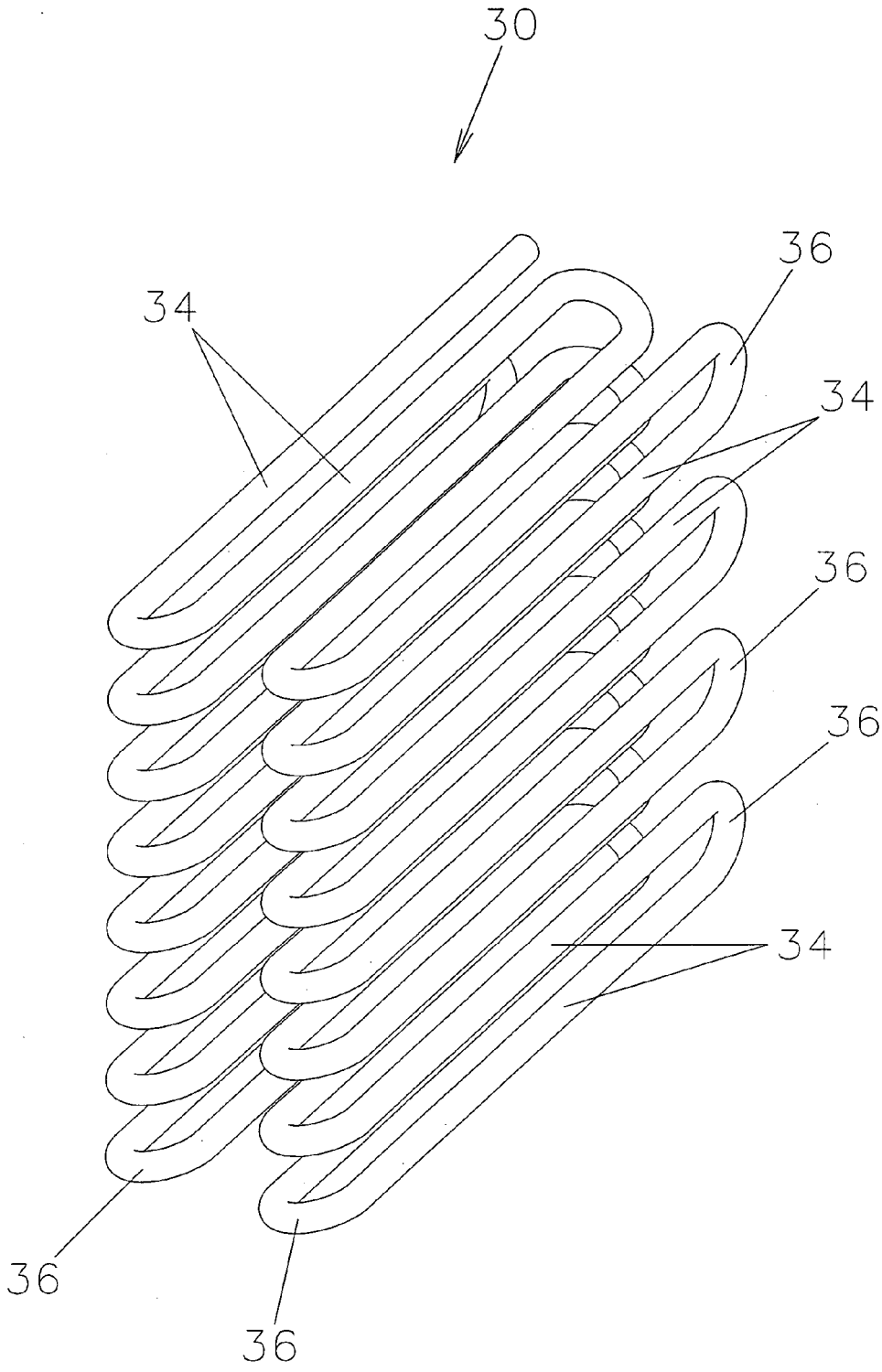
FIG. 2 is a perspective view of a tube portion of a heat exchanger according to the principles of the present invention.

Referring now to FIG. 2, there is shown a tube portion 30 (fluid transporting unit) that can be used to make a fin on tube heat exchanger 32 according to the principles of the present invention. The tube portion 30 is comprised of a plurality of straight segments 34 and a plurality of connecting segments 36. Each connecting segment 36 interconnects two straight segments 34 so that all of the straight segments 34 are interconnected and form the tube portion 30 for use in the heat exchanger 32. The tube portion 30, as is known in the art, has at least one internal passageway (not shown) that allows a fluid to flow through the tube portion 30.

Figure 3:
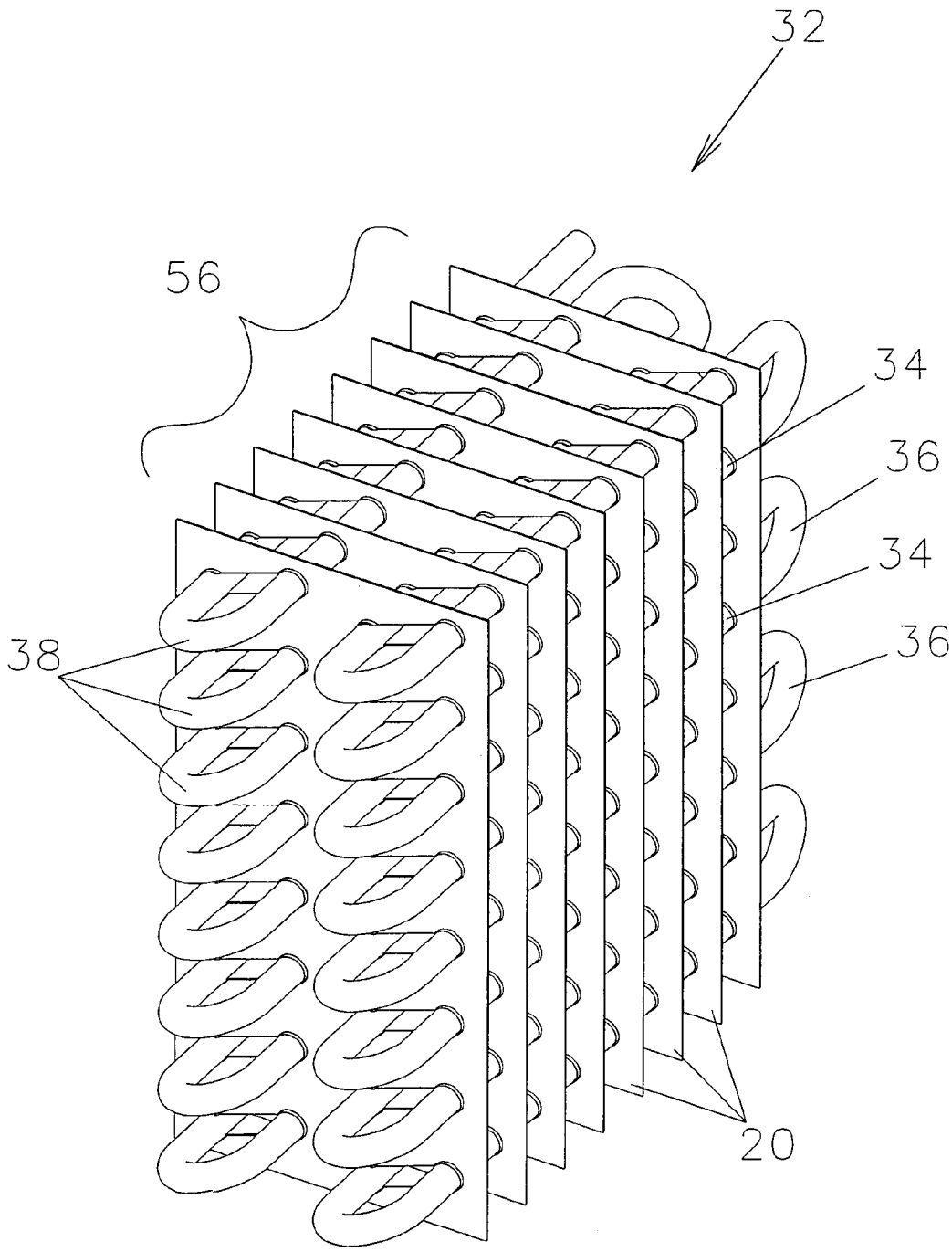
FIG. 3 is a perspective view of a heat exchanger according to the principles of the present invention having more vertical tube passes than horizontal tube passes and requiring a heat exchanger fin having two columns of openings and eight rows of openings.
Figure 4:
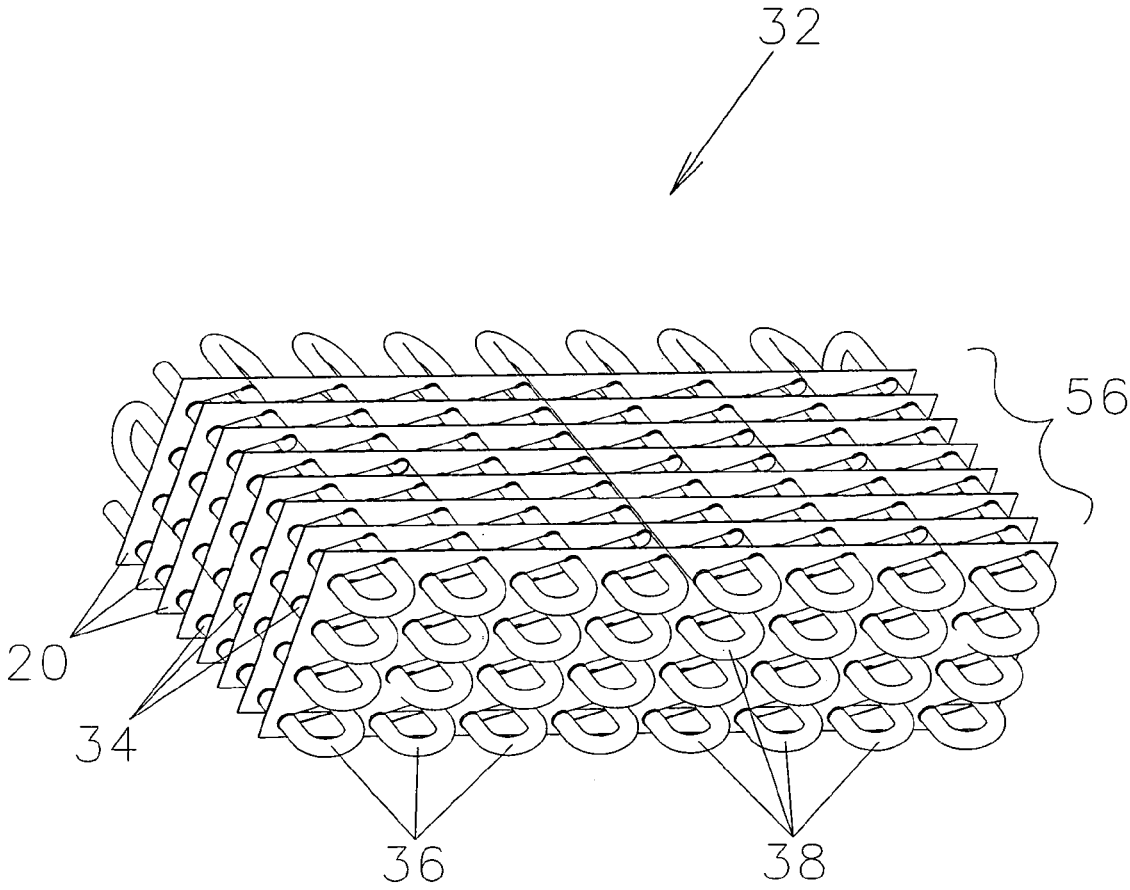
FIG. 4 is a perspective view of a heat exchanger according to the principles of the present invention having more horizontal tube passes than vertical tube passes and requiring a heat exchanger fin having eight columns of openings and four rows of openings.

The tube portion 30 has a plurality of horizontal and vertical tube passes 38. A tube pass 38 is defined as the part of the tube portion 30 that passes through a common (same) opening 22 in a fin 20. The tube portion 30 will be configured for the specific application in which the heat exchanger 32 is desired to be used. That is, the number of vertical and horizontal tube passes 38 will vary depending upon the application in which the heat exchanger 32 formed from the tube portion 30 is to be used. For example, as shown in FIGS. 2 and 3, the tube portion 30 can be configured to have two horizontal tube passes 38 and eight vertical tube passes 38 (a 2×8 configuration) or, as shown in FIG. 4, the tube portion 30 can be configured to have eight horizontal tube passes 38 and four vertical tube passes 38 (an 8×4 configuration). The tube portion 30 is configured with the tube passes 38 canted so that the heat exchanger 32 formed from the tube portion 30 efficiently transfers heat.

Each tube pass 38 is comprised of a pair 40 of straight segments 34 which pass through all or a portion of the fins 20 on the heat exchanger 32. The two straight segments 34 are interconnected by a connecting segment 36. The straight segments 34 and the connecting segments 36 are formed into a sinuous or serpentine tube portion 30, as is known in the art, to be used in the heat exchanger 32. Preferably, each straight segment 34 that forms a pair 40 of straight segments are parallel to one another. Even more preferably, all the straight segments 34 that comprise tube passes 38 are generally parallel. A single straight segment 34 could also pass through all or a portion of each fin 20 on the heat exchanger 32.

The tube portion 30 is configured so that adjacent horizontal tube passes 38 are uniformly spaced apart and adjacent vertical tube passes 38 are uniformly spaced apart. Preferably, the spacing between adjacent horizontal tube passes 38 is generally the same as the spacing between adjacent vertical tube passes 38.

Figure 7:
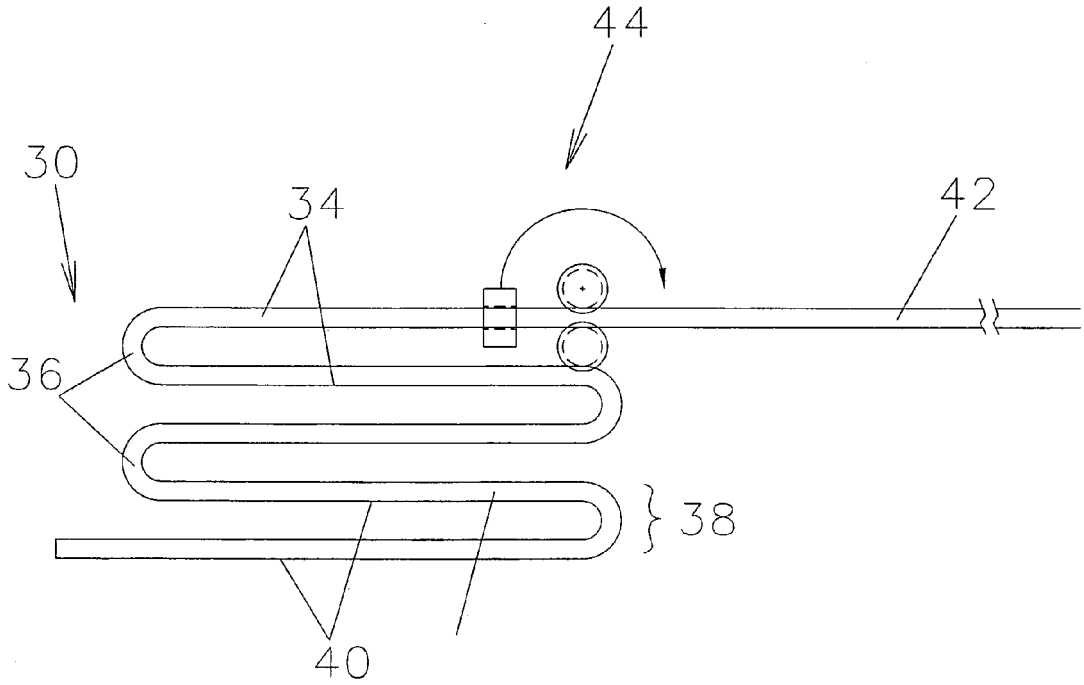
FIG. 7 is a perspective view of the tube portion of FIG. 2 being formed by bending a length of continuous tubing.

The tube portion 30 can be made in a variety of manners. For example, as shown in FIG. 7, the tube portion 30 can be made by bending a piece of continuous tubing 42 into the desired configuration. While the piece of continuous tubing 42 is shown in FIG. 7 as being bent by a tube bender 44, it should be understood that other methods of bending a piece of continuous tubing 42 into a tube portion 30 having a desired configuration can be employed and still be within the scope of the present invention. Alternatively, the tube portion 30 can be formed by connecting independent straight segments 34 with independent connecting segments 36. That is, the tube portion 30 can be assembled from a plurality of discreet components. The connecting segments 36 can be connected to the straight segments 34 by brazing, adhesives, or other means known in the art. The connecting segments 36, regardless of being discrete components or part of the tube, are slightly flattened in a rectangular die (not shown) to facilitate insertion through openings 22 in fin 20.

Referring now to FIG. 1A, it can be seen that the openings 22 in the fin 20 are configured to allow a tube pass 38 to pass therethrough. That is, the openings 22 are configured to allow a pair 40 of straight segments 34 and a slightly flattened connecting segment 36 to pass through the opening 22. The openings 22, are comprised of end portions 46 connected by a central portion 48. The end portions 46 are rounded and substantially complementary to the straight segments 34 that make up the tube portion 30. End portions 46 have a collar or flange portion 49 (best seen in FIG. 6) that contacts straight segments 34. End portions 46 have a radius that is slightly less than a radius of the straight segments 34 to allow a press-fit connection with good surface contact between straight segments 34 and fins 20. The central portion 48 connects the end portions 46 and allows the slightly flattened connecting segment 36 attached to the pair of straight segments 34 to pass therethrough so that a fin 20 having the openings 22 can be positioned on a tube portion 30 with each tube pass 38 passing through different openings 22 to form a heat exchanger 32. Preferably, the end portions 46 and the intermediate portion 48 are configured to form a "dog-bone" shape, as is known in the art. Even more preferably, each opening 22 in the fin 20 is generally identical. The openings 22 are canted relative to the height H and width W. The tube portion 30 is configured so that the tube passes 38 are also canted and are complementary to the canting of the openings 22.

Figure 5:
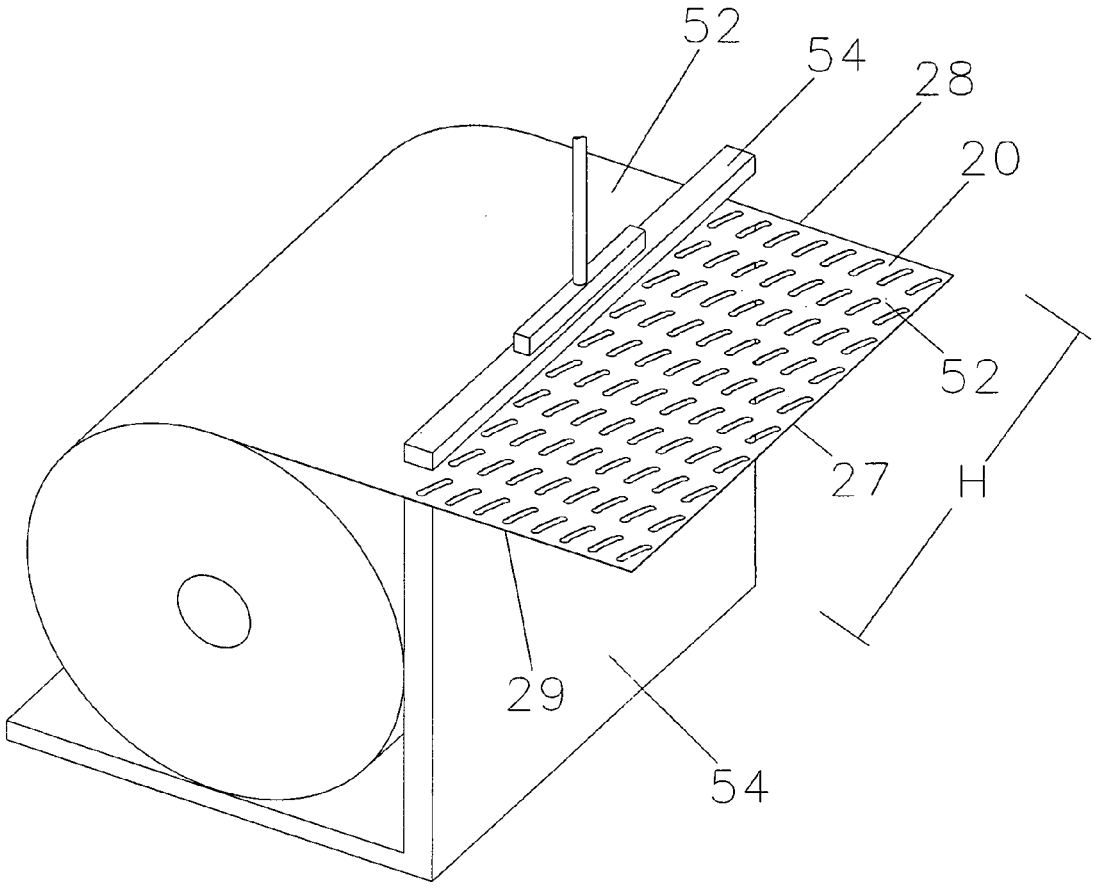
FIG. 5 is a perspective view of a heat exchanger fin according to the principles of the present invention being stamped from a sheet of heat conducting material.

As stated above, a fin 20 having any desired number of columns 24 and rows 26 of openings 22 can be formed to correspond to the needs of a heat exchanger 32 of various sizes and configurations. Referring to FIG. 5, fins 20 can be formed by stamping a sheet 52 of heat conducting material with a die stamp 54. Die stamp 54 is configured to stamp a single column 24 of openings 22 in sheet 52 with each stamp of the die. For ease of throughput, it may be desired to have the die stamp more than one column per hit although all of the advantages of the present invention may not be realized. The height H of sheet 52 determines the number of rows 26 of openings 22 that are formed with each stamp of the die. That is, as shown in FIG. 5, the height H of sheet 52 is dimensioned to cause ten rows 26 of openings 22 to be formed. If sheet 52 were one-half of the height H shown in FIG. 5, five rows 26 of openings 22 would be formed with each stamp of the die.

Thus, to make a fin 20, a sheet 52 of heat conducting material having a desired height H is positioned in die stamp 54 and a first column 24 of openings 22 is stamped in sheet 52 with the die. The first column 24 of openings is positioned away from the side edge 27 about one-half of the distance that will be imparted between adjacent columns 24. After the first column 24 is formed, sheet 52 is advanced a predetermined distance that is desired to occur between adjacent columns 24, which is also the distance between adjacent tube passes 38 of the tube portion 30, and the second column 24 is then stamped with die 54. The sheet 52 is then advanced again the same distance and another column 24 of openings 22 is stamped in sheet 52 with die 54. This continues until the desired number of columns 24 are formed in sheet 52. The sheet 52 is then cut by a cutting blade (not shown) at a position from the last column 24 that is about one-half of the distance between adjacent columns. Thus, a fin 20 is formed having a desired number of columns 24 and rows 26 of openings 22 with the columns 24 being evenly spaced apart and a distance from the outermost columns to the closest side edge 27 being about one-half the distance between adjacent columns 24 in a direction substantially parallel to top or bottom edge 28, 29. Preferably, the die is arranged so that the rows 26 are uniformly spaced apart and also preferably the spacing between adjacent columns 24 is chosen to be the same as the spacing between adjacent rows 26.

The uniform spacing between columns 24 enables a tube portion 30 to be formed having tube passes 38 that are equally spaced apart. The equally spacing apart of the tube passes 38 provides an efficient compact design for the heat exchanger 32 that is simple to make. In other words, since the spacing between the tube passes 38 is uniform, special accommodation in the spacing between adjacent tube passes 38 is avoided. The heat exchanger 32 so formed has a fin 20 with a distance from an outermost portion of an opening 22 in an outermost column to a nearest side edge 27 being about one-half of a distance between closest portions of parallel straight segments 34 of tube portion 30 in a direction substantially parallel to top or bottom edge 28, 29.

Figure 1B:
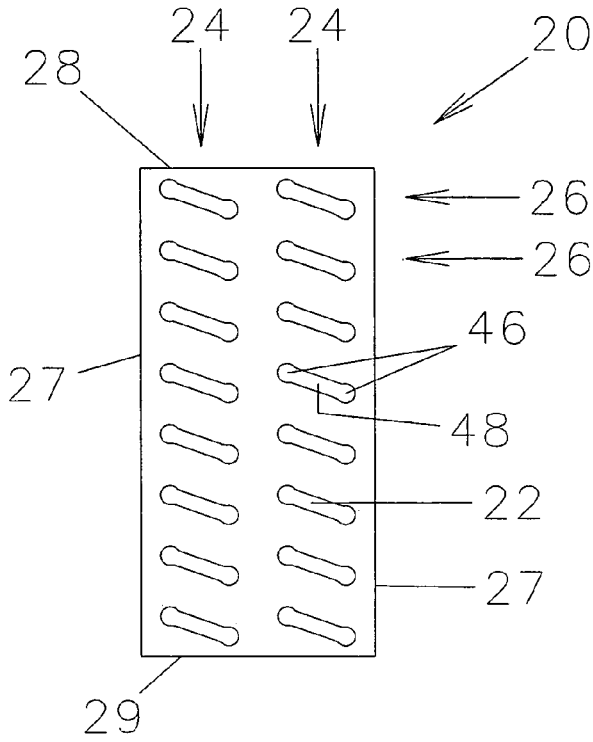
FIGS. 1B and 1C are front elevation views of heat exchanger fins that can be formed according to the principles of the present invention.
Figure 1C:
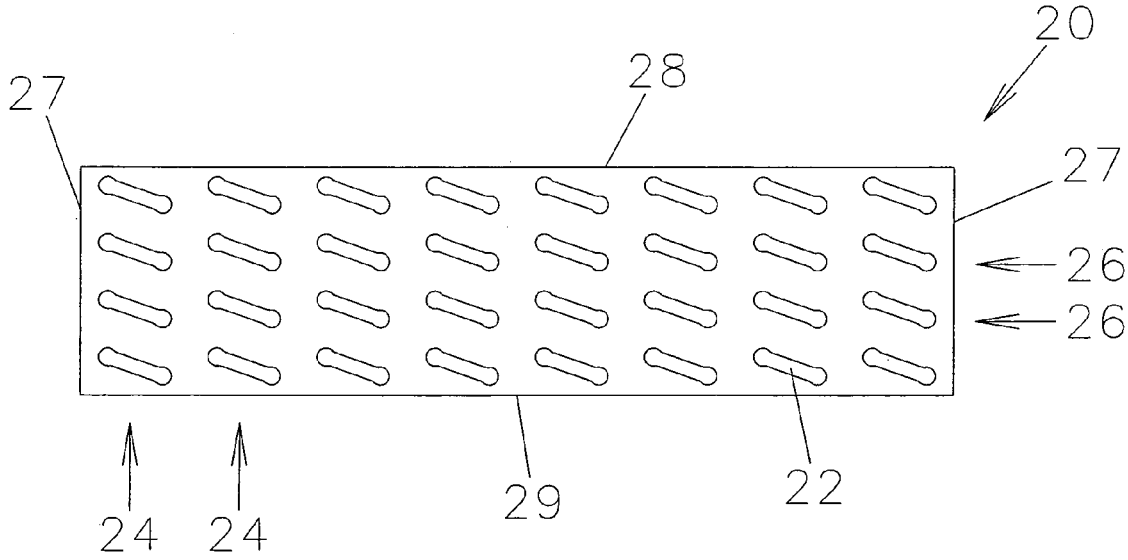

Thus, a fin 20 according to the principles of the present invention can be made to have a desired number of columns 24 and rows 26 of openings 22 to meet the specific configuration of a tube portion 30 to form a heat exchanger 32. For example, as shown in FIG. 1B, a sheet 52 of heat conducting material can be used to manufacture a fin 20 having two columns 24 and eight rows 26 of openings 22 by using a sheet 52 having a height H sufficient to cause die 54 to produce eight rows 26 of openings 22 per stamp. Additionally, the columns 24 are formed by stamping the sheet 52 twice with the die 54 and then cutting sheet 52 to form the fin 20. The fins 20 so formed can then be used to form the heat exchanger 32 shown in FIG. 3. In a different configuration, for example, a fin 20 according to the principles of the present invention can be produced from a sheet 52 to have eight columns 24 and four rows 26 of openings 22, as shown in FIG. 1C. This is accomplished by providing a sheet 52 having a height H sufficient to cause die 54 to produce four rows 26 of openings 22 with each punch of the die 54. The sheet 52 is then stamped with die 54 eight times while moving sheet 52 along die stamp 54 between each stamp to produce the eight columns 24 that are all equally spaced apart. The fin 20 is then cut from sheet 52 to produce the fin 20 shown in FIG. 1C. The fins 20 so formed can then be used to form the heat exchanger 32 shown in FIG. 4. Thus, the present invention provides for making a fin 20 having a desired number of columns 24 and rows 26 of openings 22 to fit on a tube portion 30 to form heat exchanger 32.

Figure 6:
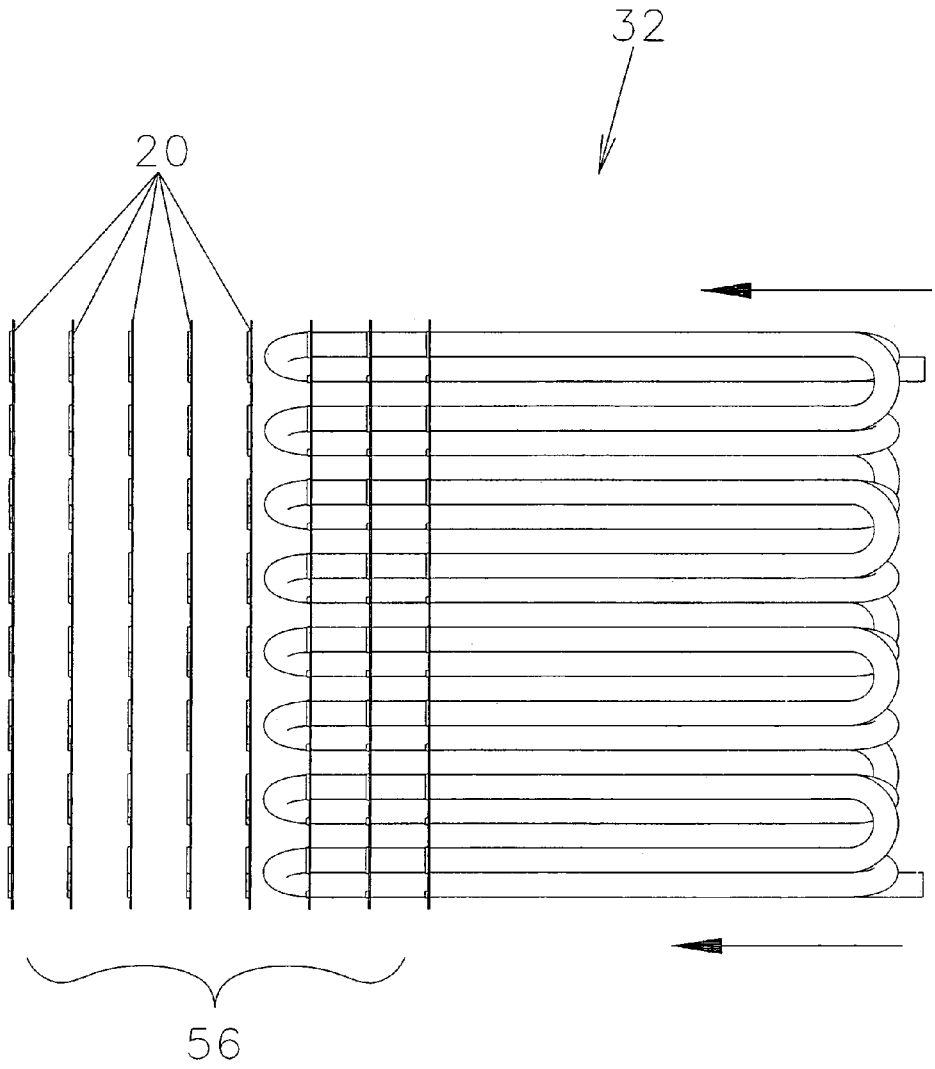
FIG. 6 is a perspective view of heat exchanger fins being arranged on the tube portion of FIG. 2.

To assemble heat exchanger 32, the desired number of fins 20 are formed and arranged in a fin bank 56, as shown in FIG. 6. The fin bank 56 and/or tube portion 30 are aligned with one another and moved relative to one another so that tube passes 38 pass through openings 22 in fins 20 of fin bank 56, as is known in the art. The fins 20 can be secured to the tube portion 30, by a variety of methods. Preferably the fins 20 are attached to the tube portion 30 by a mechanical or interference fit. The openings 22 can be configured so that the end portions 48 deform slightly as a result of the tube passes 38 extending through the openings 22. The deformation of the end portions 48 mechanically retain the fins 20 at desired locations on the tube portion 30 and provide good surface contact between fins 20 and tube portion 30. Alternatively, other methods of attaching the fins 20 to the desired location of the tube portion 30, such as by brazing and/or adhesives, may be employed.

Figure 8:
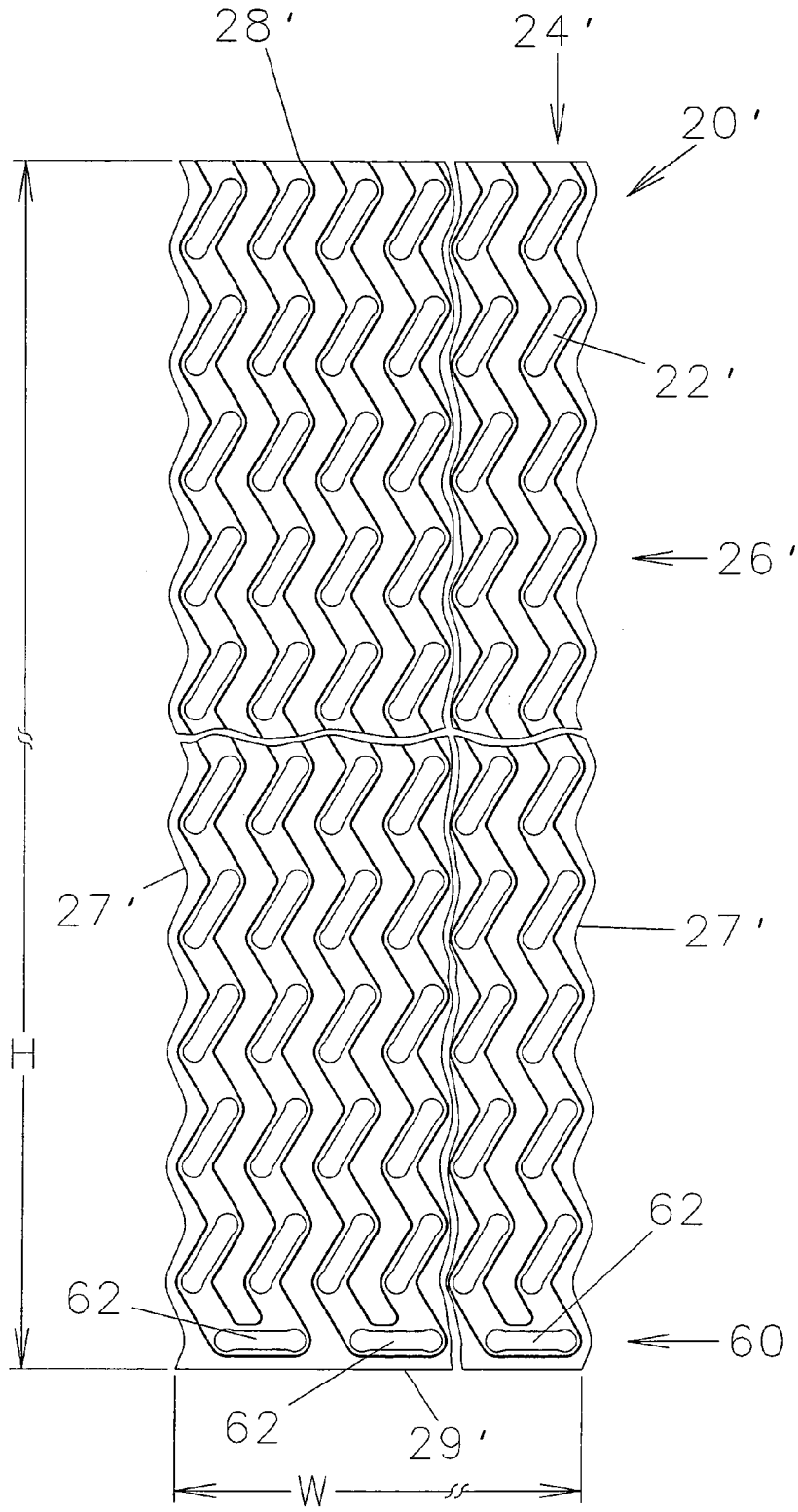
FIG. 8 is a front elevation view of an alternate heat exchanger fin according to the principles of the present invention.
Figure 9:
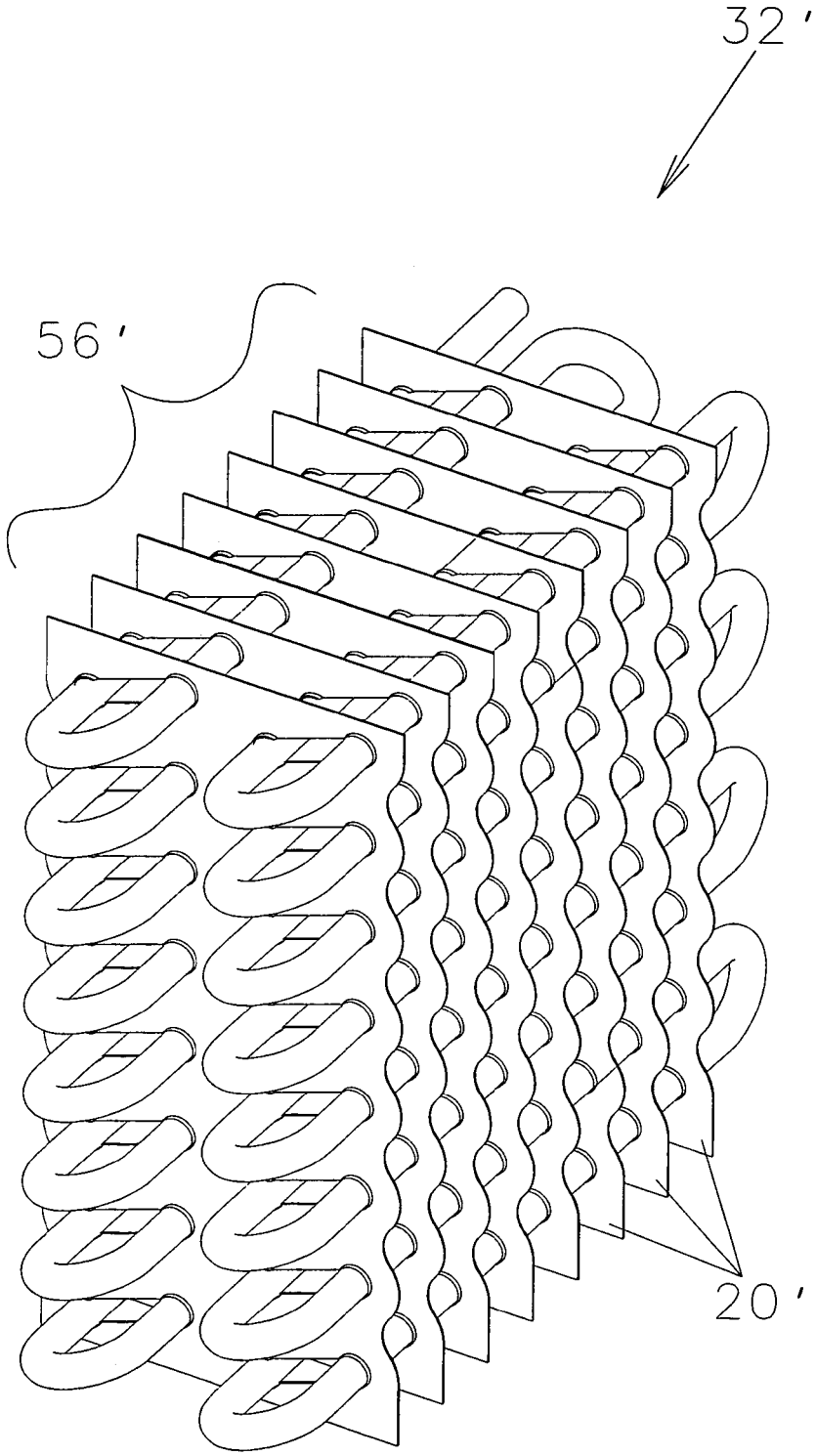
FIG. 9 is a perspective view of a heat exchanger having the alternate heat exchanger fins according to the principles of the present invention.

Referring now to FIG. 8, an alternate fin 20' is shown. Fin 20' is substantially the same as fin 20 shown in FIGS. 1A–6, with the key difference being that the side edges 27 are cut so as to be undulating or scalloped. Additionally, an optional lowermost row 60 of openings 62 is formed so that the lowermost openings 62 extend substantially parallel to the bottom edge 29 and are substantially orthogonal to the columns 24. The lowermost row 60 of openings 62 can be formed by configuring one end of die stamp 54 to produce the lowermost opening 62 or by providing another die stamp (not shown) configured to produce the lowermost row 60 of opening 62 in sheet 52 and/or fin 20. Openings 62 are designed to correspond with a tube pass (not shown) that goes from one column 24' to an adjacent column 24'. The fins 20' can then be assembled into a fin bank 56' and used to form a heat exchanger 32', such as that shown in FIG. 9.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A heat exchanger fin comprising:

a heat conducting sheet having a top edge, a bottom edge, and a pair of side edges extending between said top and bottom edges; and at least two columns of openings in said sheet, said columns extending substantially parallel to said side edges, each of said openings in said columns configured to allow at least a pair of substantially parallel portions of a tube portion to pass therethrough, said columns being equally spaced apart, and a distance from an outermost portion of an opening in an outermost one of said at least two columns to a nearest side edge in a direction substantially perpendicular to said nearest side edge being about one-half of a distance between adjacent ones of said at least two columns in a direction substantially perpendicular to said nearest side edge.

2. The fin of claim 1, wherein said openings are elongated openings with each opening having opposite end portions interconnected by a central portion.

3. The fin of claim 1, wherein a distance between either outermost column to a nearest side edge in a direction substantially perpendicular to said nearest side edge is about one-half a distance between any two adjacent columns in a direction substantially perpendicular to said nearest side edge.

4. The fin of claim 1, wherein adjacent openings in adjacent columns form a plurality of rows, each row extending substantially parallel to at least one of said top and bottom edges, and each row being substantially equally spaced apart.

5. The fin of claim 4, wherein said spacing between said rows is substantially the same as said spacing between said columns.

6. The fin of claim 1, wherein said openings are canted relative to said side edges.

7. The fin of claim 1, further comprising at least one lowermost opening configured to allow at least a pair of substantially parallel portions of a tube portion to pass therethrough and said lowermost opening extending substantially orthogonally relative to said columns.

8. A heat exchanger comprising:

a tube portion including a plurality of straight segments interconnected by a plurality of connecting segments with each connecting segment interconnecting two straight segments, said straight and connecting segments being arranged in a sinuous configuration; and at least one heat conducting fin on said tube portion, said fin having a top edge, a bottom edge, and a pair of side edges extending between said top and bottom edges, said fin having at least two columns of openings equally spaced apart and a plurality of rows of openings, said columns extending substantially perpendicular to said top edge, each of said openings in said columns configured to allow at least a pair of parallel straight segments of said tube portion to pass therethrough, and a distance from an outermost portion of an opening in an outermost one of said at least two columns to a nearest side edge in a direction substantially parallel to said top edge being about one-half of a distance between adjacent ones of said at least two columns in a direction substantially parallel to said top edge.

9. The heat exchanger of claim 8, wherein said tube portion is a single continuous tube.

10. The heat exchanger of claim 8, wherein said at least one fin is one of a plurality of fins and said plurality of fins are aligned in a generally parallel configuration with said openings aligned to form a fin bank that is arranged on said tube portion.

11. The heat exchanger of claim 8, wherein said openings in said fin are elongated openings with each opening having opposite end portions interconnected by a central portion.

12. The heat exchanger of claim 8, wherein a distance between either outermost column to a nearest side edge in a direction substantially parallel to said nearest top edge is about one-half a distance between any two adjacent columns in a direction substantially parallel to said nearest top edge.

13. The heat exchanger of claim 8, wherein said openings are canted relative to said side edges.

14. The heat exchanger of claim 8, wherein a majority of said openings have a pair of parallel straight segments of said tube portion passing therethrough.

15. The heat exchanger of claim 8, wherein each row is substantially equally spaced apart and said spacing between said rows is substantially the same as said spacing between said columns.

16. The heat exchanger of claim 8, wherein said fin includes at least one lowermost opening configured to allow at least a pair of substantially parallel straight segments of said tube portion to pass therethrough and said lowermost opening extending substantially orthogonally relative to said columns.

17. A method of making a heat exchanger comprising:

(a) forming at least one heat conductive fin having a predetermined plurality of columns of openings extending therethrough with said columns extending substantially parallel to a side edge of said fin, each of said openings in said columns configured to allow at least a pair of substantially parallel portions of a tube portion to pass therethrough, said columns being equally spaced apart, and with a distance from an outermost portion of an opening in an outermost column to a nearest side edge of said fin in a direction substantially perpendicular to said side side edge being about one-half of a distance between adjacent columns in a direction substantially perpendicular to said side edge; and (b) positioning said fin in heat conducting contact on a tube portion with a majority of said openings having at least a pair of substantially parallel portions of said tube portion passing therethrough.

18. The method of claim 17, wherein (a) includes separately forming each column of openings in said fin.

19. The method of claim 17, wherein (a) includes forming said fin from a sheet of heat conducting material having a predetermined height so that a predetermined number of openings are formed in each column.

20. The method of claim 17, wherein (a) includes cutting said fin from a sheet of fin material once a predetermined number of columns have been formed.

21. The method of claim 20, wherein (a) includes stamping said predetermined number of columns.

22. The method of claim 17, wherein (a) includes forming said openings in said columns with said openings being equally spaced apart in each of said columns.

* * * * *

UNITED STATES PATENT AND TRADEMARK OFFICE

CERTIFICATE OF CORRECTION

PATENT NO. : 7,073,574 B2
APPLICATION NO. : 10/785771
DATED : July 11, 2006
INVENTOR(S) : David W. Smithey and Milan A. Virsik It is certified that error appears in the above-identified patent and that said Letters Patent is hereby corrected as shown below:

Column 9, line 15, claim 17, delete "side" (second occurrence).

Signed and Sealed this

Seventh Day of August, 2007

JON W. DUDAS
*Director of the United States Patent and Trademark Office*